US009412219B2

(12) United States Patent
Salmon et al.

(10) Patent No.: US 9,412,219 B2
(45) Date of Patent: Aug. 9, 2016

(54) GAMING SYSTEM AND A METHOD OF GAMING

(75) Inventors: Christian James Salmon, Maidstone (AU); Rowan Arthur Newman Bond, Elwood (AU)

(73) Assignee: ARISTOCRAT TECHNOLOGIES AUSTRALIA PTY LIMITED (AU)

( * ) Notice: Subject to any disclaimer, the term of this patent is extended or adjusted under 35 U.S.C. 154(b) by 808 days.

(21) Appl. No.: 13/013,410

(22) Filed: Jan. 25, 2011

(65) Prior Publication Data

US 2011/0183742 A1 Jul. 28, 2011

(30) Foreign Application Priority Data

Jan. 25, 2010 (AU) ..... 2010900283

(51) Int. Cl.
*G07F 17/32* (2006.01)

(52) U.S. Cl.
CPC ..... *G07F 17/32* (2013.01); *G07F 17/3267* (2013.01)

(58) Field of Classification Search
CPC ..... G07F 17/32
USPC ..... 463/16, 20, 25.2, 9
IPC ..... G07F 17/32
See application file for complete search history.

(56) References Cited

U.S. PATENT DOCUMENTS

| | | | |
|---|---|---|---|
| 6,254,483 | B1 | 7/2001 | Acres |
| 2001/0055990 | A1 | 12/2001 | Acres |
| 2002/0039917 | A1 | 4/2002 | Armstrong et al. |
| 2002/0043763 | A1 | 4/2002 | Lorenzin |
| 2002/0045473 | A1 | 4/2002 | Walker et al. |
| 2003/0040352 | A1 | 2/2003 | Marks et al. |
| 2003/0064771 | A1* | 4/2003 | Morrow ..... G07F 17/323 463/16 |
| 2003/0176212 | A1 | 9/2003 | Schlottmann et al. |
| 2004/0150162 | A1 | 8/2004 | Okada |
| 2004/0185929 | A1 | 9/2004 | Walker et al. |
| 2004/0227293 | A1 | 11/2004 | Piccoli et al. |
| 2005/0029745 | A1 | 2/2005 | Walker et al. |
| 2005/0032573 | A1 | 2/2005 | Acres et al. |
| 2005/0059452 | A1 | 3/2005 | Hartl |
| 2006/0068881 | A1 | 3/2006 | Casey |
| 2006/0119044 | A1 | 6/2006 | Kekempanos et al. |
| 2006/0172796 | A1 | 8/2006 | Vancura |

(Continued)

FOREIGN PATENT DOCUMENTS

| | | | |
|---|---|---|---|
| CA | 2442442 | A1 | 10/1998 |
| CA | 2272499 | A1 | 11/1999 |

(Continued)

*Primary Examiner* — Omkar Deodhar
(74) *Attorney, Agent, or Firm* — McAndrews, Held & Malloy, Ltd.

(57) ABSTRACT

A method of gaming comprising providing a plurality of display positions and selecting a plurality of symbols for display at respective display positions. A base pay table is defined and is usable to determine a prize for a winning outcome when a winning outcome associated with a particular prize comprising a defined win combination of x symbols occurs. It is determined whether a winning outcome exists and, during normal game mode, the base pay table is used to determine a particular prize applicable for a winning outcome when the winning outcome occurs. It is also determined whether a trigger condition exists and if the trigger condition is determined, special game mode is implemented during which the special pay table is used to determine a particular prize applicable for a winning outcome when the winning outcome occurs.

16 Claims, 8 Drawing Sheets

(56) References Cited

U.S. PATENT DOCUMENTS

| | | | | |
|---|---|---|---|---|
| 2007/0004508 | A1 | 1/2007 | Walker et al. | |
| 2007/0069470 | A1 | 3/2007 | Snow | |
| 2008/0081689 | A1 | 4/2008 | Seelig et al. | |
| 2008/0242424 | A1 | 10/2008 | Liu et al. | |
| 2009/0005143 | A1 | 1/2009 | Frohm et al. | |
| 2009/0042652 | A1 * | 2/2009 | Baerlocher et al. | 463/42 |
| 2009/0085295 | A1 | 4/2009 | Johnson | |
| 2009/0093299 | A1 | 4/2009 | Acres | |
| 2010/0004047 | A1 * | 1/2010 | Acres | 463/20 |

FOREIGN PATENT DOCUMENTS

| | | | |
|---|---|---|---|
| CA | 2385730 | A1 | 11/2002 |
| CA | 2573519 | A1 | 9/2007 |
| CA | 2603607 | A1 | 3/2008 |
| DE | 3118760 | A1 | 12/1982 |
| EP | 1035525 | A1 | 9/2000 |
| GB | 2403054 | A | 12/2004 |
| JP | 2000153055 | A | 6/2000 |
| JP | 2000225264 | A | 8/2000 |
| JP | 2003180942 | A | 7/2003 |
| JP | 2006110259 | A | 4/2006 |
| JP | 2008049050 | A | 3/2008 |
| JP | 2008068078 | A | 3/2008 |
| KR | 20040012274 | A | 2/2004 |
| KR | 20040052438 | A | 6/2004 |
| RU | 2349958 | C1 | 3/2009 |

* cited by examiner

GAMING SYSTEM AND A METHOD OF GAMING

RELATED APPLICATIONS

This application claims priority to Australian Provisional Application No. 2010900283, having a filing date of Jan. 25, 2010, which is incorporated herein by reference in its entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

The present invention relates to a gaming system and to a method of gaming.

It is known to provide a gaming system arranged to randomly display several symbols from a predetermined set of symbols and to determine a game outcome such as a game win based on the displayed symbols. In some arrangements, a win outcome is determined by comparing the occurrence of symbols with a pay table so that a corresponding prize may be awarded to a player.

Such gaming systems may commonly be implemented as a stepper machine provided with reels with each reel carrying several symbols of the set, or a video machine wherein selected symbols are displayed on virtual reels on a graphical display device.

However, while such gaming systems provide users with enjoyment, a need exists for alternative gaming systems in order to maintain or increase player enjoyment.

BRIEF SUMMARY OF THE INVENTION

In accordance with a first aspect of the present invention there is provided a method of gaming comprising:

providing a plurality of display positions;

selecting a plurality of symbols for display at respective display positions;

defining a base pay table usable to determine a prize applicable for a winning outcome when the winning outcome occurs, wherein a winning outcome associated with a particular prize comprises a defined win combination of x symbols;

defining a special pay table usable to determine a prize applicable for a winning outcome when the winning outcome occurs, wherein for a particular prize defined in both the base pay table and the special pay table, a winning outcome defined in the special pay table and associated with the particular prize comprises less than x of the symbols of the defined win combination;

determining whether a winning outcome exists;

during normal game mode, using the base pay table to determine a particular prize applicable for a winning outcome when the winning outcome occurs;

determining whether a trigger condition exists;

implementing special game mode when a trigger condition is determined; and during special game mode, using the special pay table to determine a particular prize applicable for a winning outcome when the winning outcome occurs.

The defined win combination may comprise multiple symbols of the same kind. The defined win combination may be any win combination associated with card games such as poker. The defined win combination may comprise a sequence of symbols, such as a sequence of numbers.

In one embodiment, a winning outcome defined in the special pay table and associated with the particular prize comprises x−1 of the symbols of the defined win combination.

In one embodiment, the method comprises modifying the base pay table so as to form the special pay table.

In one embodiment, the method comprises displaying the base pay table and/or the special pay table. In one embodiment, the base pay table and the special pay table are displayed concurrently. In an alternative embodiment, the base pay table is displayed during normal game mode and the special pay table is displayed during special game mode. In one embodiment, the special pay table replaces the base pay table during special game mode.

It will be appreciated that displaying the pay table and/or the special pay table may comprise displaying information relating to the pay table and/or the special pay table.

The trigger condition may occur when a specific game outcome occurs.

In addition, the trigger condition may occur when a game event occurs during a game such as display of a particular symbol, in response to player input, based on the amount or type of bet placed. Alternatively, the trigger condition may occur when a special game is purchased by a player.

In accordance with a second aspect of the present invention there is provided a gaming system comprising:

a symbol selector arranged to select a plurality of symbols for display at a corresponding plurality of display positions;

a trigger condition determiner arranged to determine whether a trigger condition exists;

a feature implementer arranged to implement a special game mode when a trigger condition occurs, an outcome evaluator arranged to determine whether selected symbols correspond to a winning symbol combination;

a base pay table usable to determine a prize applicable for a winning outcome when the winning outcome occurs, wherein a winning outcome associated with a particular prize comprises a defined win combination of x symbols;

a special pay table usable to determine a prize applicable for a winning outcome when the winning outcome occurs, wherein for a particular prize defined in both the base pay table and the special pay table, a winning outcome defined in the special pay table and associated with the particular prize comprises less than x of the symbols of the defined win combination;

a prize allocator arranged to allocate a prize to a player when a winning symbol combination exists; wherein in normal game mode the prize is determined from the base pay table; and in special game mode the prize is determined from the special pay table.

The defined win combination may comprise multiple symbols of the same kind. The defined win combination may comprise any win combination associated with a card game.

In one embodiment, a winning outcome defined in the special pay table and associated with the particular prize comprises x−1 of the symbols of the defined win combination.

The system may be arranged so as to modify the base pay table so as to form the special pay table.

In one embodiment, the system is arranged so as to display the base pay table and/or the special pay table.

In an alternative embodiment, the system is arranged such that the base pay table and the special pay table are displayed concurrently.

The system may be arranged such that the base pay table is displayed during normal game mode and the special pay table is displayed during special game mode.

In one embodiment, the system is arranged such that the special pay table is displayed in place of the base pay table during special game mode.

In accordance with a third aspect of the present invention there is provided a computer program arranged when loaded into a computer to instruct the computer to operate in accordance with the gaming system of the second aspect.

In accordance with a fourth aspect of the present invention, there is provided a computer readable medium having a computer readable program code embodied therein for causing a computer to operate in accordance with the gaming system of the second aspect.

In accordance with a fifth aspect of the present invention, there is provided a data signal having a computer readable program code embodied therein to cause a computer to operate in accordance with the gaming system of the second aspect.

BRIEF DESCRIPTION OF SEVERAL VIEWS OF THE DRAWINGS

The present invention will now be described by way of example only, with reference to the accompanying drawings, in which.

DETAILED DESCRIPTION OF THE INVENTION

Figure 1:
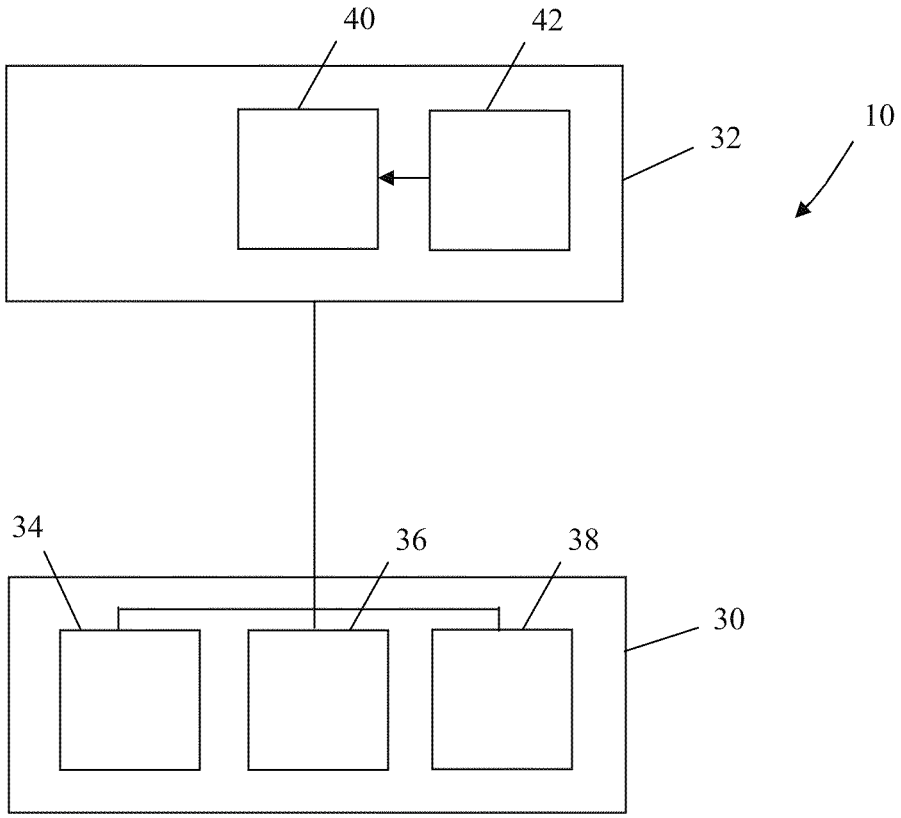
FIG. 1 is a schematic block diagram of components of a gaming system in accordance with an embodiment of the present invention.

The present gaming system operates such that during game play a plurality of symbols are randomly selected from a set of symbols and displayed at a corresponding plurality of display positions, the symbols shown at the display positions being used to determine game outcomes by comparing the displayed symbols with defined winning combinations.

In one conventional type of gaming machine, a display area including 15 display positions is presented to a player with each display position including one symbol. The display positions are arranged in five vertically disposed reels with each reel having three visible display positions. After the reels are spun and subsequently stopped, the display positions show a random selection of symbols. Generally, with such games a plurality of win patterns in the form of win lines are defined which extend across the reels and include one display position from each reel. Typically the symbols that form a win line are compared with winning symbol combinations defined in a pay table so as to determine whether a player of the game should receive an award. For example, if winning symbol combinations are based on poker hands, a particular prize would be awarded if the win line comprises four aces. Other winning symbol combinations and corresponding prizes may also be defined by a pay table.

The game comprises normal game mode and special game mode. During normal game mode, a defined number of symbols are required to achieve a particular prize. During special game mode, the gaming system is arranged to decrease the number of symbols required to achieve the particular prize. For example, if four aces are required to achieve a particular prize during normal game mode, during special game mode a win line comprising only three aces will result in the player being awarded the particular prize. As a consequence, the likelihood of obtaining a larger prize increases and the likelihood of obtaining a winning outcome increase.

Referring to the drawings, there is shown a schematic block diagram of a gaming system 10 arranged to implement a probabilistic game of the type wherein several symbols from a set of symbols are randomly displayed, and a game outcome is determined on the basis of the displayed symbols. The system is of the type including multiple game modes such as being operable in normal game mode wherein a base game is implemented and special game mode wherein a feature game is implemented.

With some such probabilistic games, the set of symbols used during normal game mode include standard symbols and function symbols, and the game outcome is determined on the basis of the displayed standard symbols and the function associated with any displayed function symbol. For example, standard symbols may resemble fruit such as apples, pears and bananas with a win outcome being determined when a predetermined number of the same fruit appear on a display along a win line, or are displayed according to defined outcome patterns such as scattered, and so on. The function associated with a function symbol may be for example a wild function wherein display of the function symbol is treated during consideration of the game outcome as any of the standard symbols. A function symbol may be represented as the word "WILD", a star, or by any other suitable word or symbol. Other functions are also envisaged such as scatter functions, multiplier functions, repeat win functions, jackpot functions and feature commencement functions.

Referring to FIG. 1, a schematic diagram of components of a gaming system 10 in accordance with the present embodiment is shown. The components comprise a player interface 30 and a game controller 32. The player interface 30 is arranged to enable interaction between a player and the gaming system and for this purpose includes input/output components required for the player to enter instructions and play the game.

Components of the player interface 30 may vary but will typically include a credit mechanism 34 to enable a player to input credits and receive payouts, one or more displays 36 which may comprise a touch screen, and a game play mechanism 38 arranged to enable a player to input game play instructions.

The game controller 32 is in data communication with the player interface 30 and typically includes a processor 40 arranged to process game play instructions and output game player outcomes to the display 36. Typically, the game play instructions are stored as program code in a memory 42 that can also be hardwired. It will be understood that in this specification the term "processor" is used to refer generically to any device that can process game play instructions and may include a microprocessor, microcontroller, programmable logic device or other computational device such as a personal computer or a server.

Figure 2:
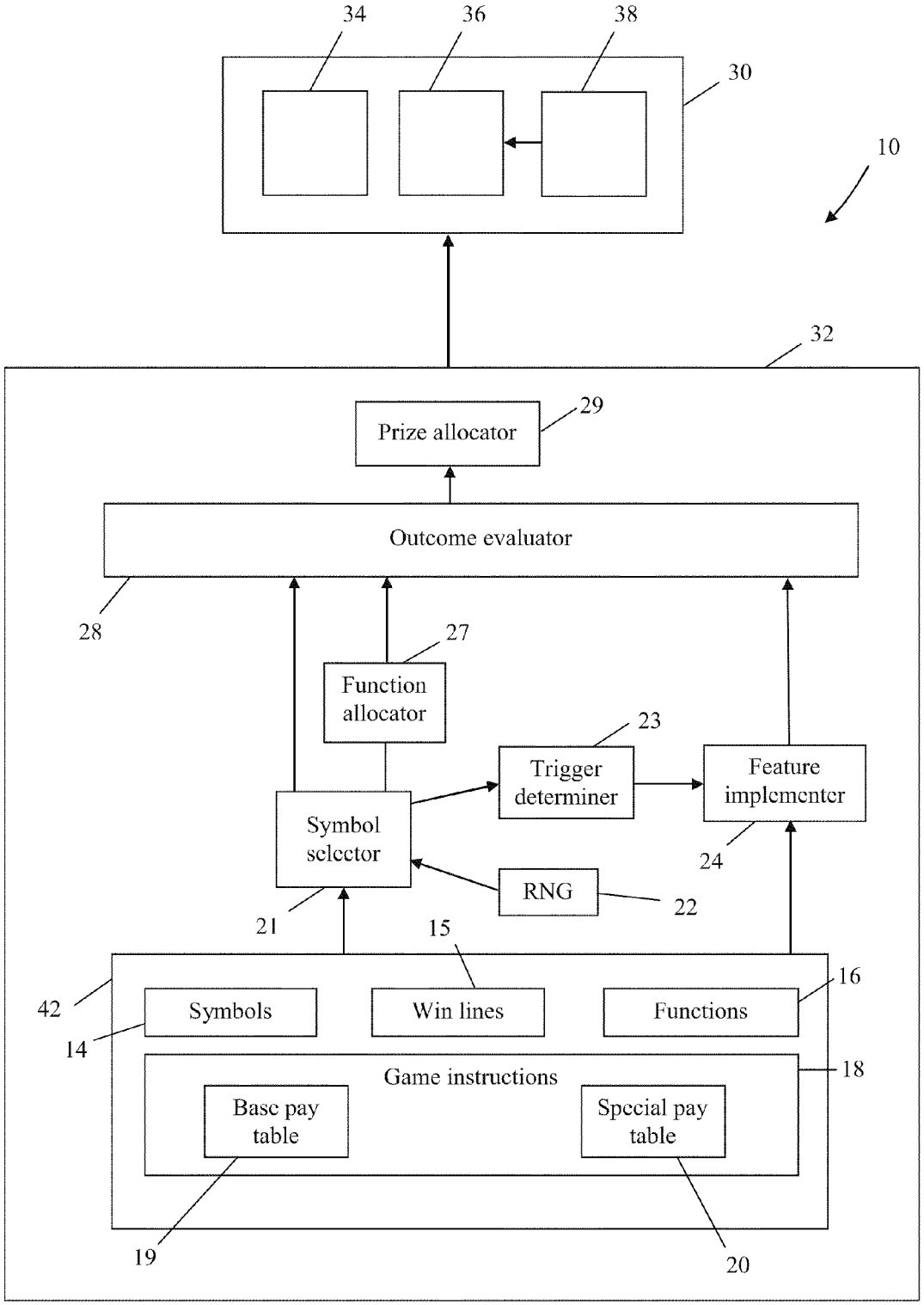
FIG. 2 is a schematic block diagram of functional components of a gaming system in accordance with an embodiment of the present invention.

A functional diagram illustrating operative components of the game controller 32 is shown in FIG. 2.

The memory 42 is arranged to store symbols data 14 indicative of a plurality of symbols, in the present example associated with a plurality of reels, win lines data 15 indicative of available win lines, function data 16 indicative of one or more functions allocatable to the symbols, and game instruction data 18 indicative of game instructions usable by the gaming machine 10 to control operation of the game. The game instruction data 18 comprises base pay table data 19 indicative of defined win combinations and associated prizes when a base game is played, and special pay table data 20 indicative of defined win combinations and associated prizes when a feature game is played.

The game controller 32 includes a symbol selector 21 which is arranged to select several symbols from the available symbols 14 for display to a player in a plurality of display positions, in this example by spinning reels containing the symbols and stopping the reels so as to display at least one symbol on each reel. In this example, the selection carried out by the symbol selector 21 is made using a random number generator 22.

It will be appreciated that the random number generator 22 may be of a type which is arranged to generate pseudo random numbers based on a seed number, and that in this specification the term "random" will be understood accordingly to mean truly random or pseudo random.

With this embodiment, the game controller 32 also comprises a trigger determiner 23 arranged to determine whether a trigger condition exists and to instruct a feature implementer 24 to implement a special game mode when a trigger condition has been detected. Such a trigger condition may be the display of a particular symbol or combination of symbols.

The feature implementer 24 causes the special pay table data 20 to be used in determining a prize when an associated defined win combination occurs during special game mode. The special pay table data 20 is arranged such that the number of symbols required to achieve a particular prize is reduced compared to the base pay table data 19.

In this example, the game controller 32 also comprises a function allocator 27 arranged to select and allocate one or more functions to one or more symbols. Such functions include a wild function, a scatter function, or any other function which may be applied to a symbol or to the game.

The game controller 32 also comprises an outcome evaluator 28 which in accordance with game instructions 18 and the associated base and special pay table data 19, 20 determines game outcomes based on the symbols selected for display to the player by the symbol selector 21.

The game controller 32 also comprises a prize allocator 29 arranged to allocate a prize to a player when a winning outcome exists.

In this example, the gaming system is operable in normal game mode and special game mode.

During normal game mode, a base pay table is used to determine whether a winning outcome exists and a prize awarded to a player for the winning outcome. During special game mode, the gaming system is arranged such that an alternate special pay table is used to determine a prize for the player when a winning symbol combination occurs.

In the embodiment described below, the symbol selector 21, the trigger determiner 23, the feature implementer 24, the function allocator 27, the outcome evaluator 28, and the prize allocator 29 are at least partly implemented using the processor 40 and associated software although it will be understood that other implementations are envisaged.

The gaming system 10 can take a number of different forms.

In a first form, a player operable gaming device in the form of a stand alone gaming machine is provided wherein all or most components required for implementing the game are present in the gaming machine.

In a second form, a distributed architecture is provided wherein some of the components required for implementing the game are present in a player operable gaming device and some of the components required for implementing the game are located remotely relative to the gaming device. For example, a "thick client" architecture may be used wherein part of the game is executed on a player operable gaming terminal and part of the game is executed remotely, such as by a gaming server; or a "thin client" architecture may be used wherein most of the game is executed remotely such as by a gaming server and a player operable gaming terminal is used only to display audible and/or visible gaming information to the player and receive gaming inputs from the player.

However, it will be understood that other arrangements are envisaged. For example, an architecture may be provided wherein a gaming device is networked to a device server and the respective functions of the gaming machine and the gaming server are selectively modifiable. For example, the gaming system may operate in stand alone gaming machine mode, "thick client" mode or "thin client" mode depending on the game being played, operating conditions, and so on. Other variations will be apparent to persons skilled in the art.

Figure 3:
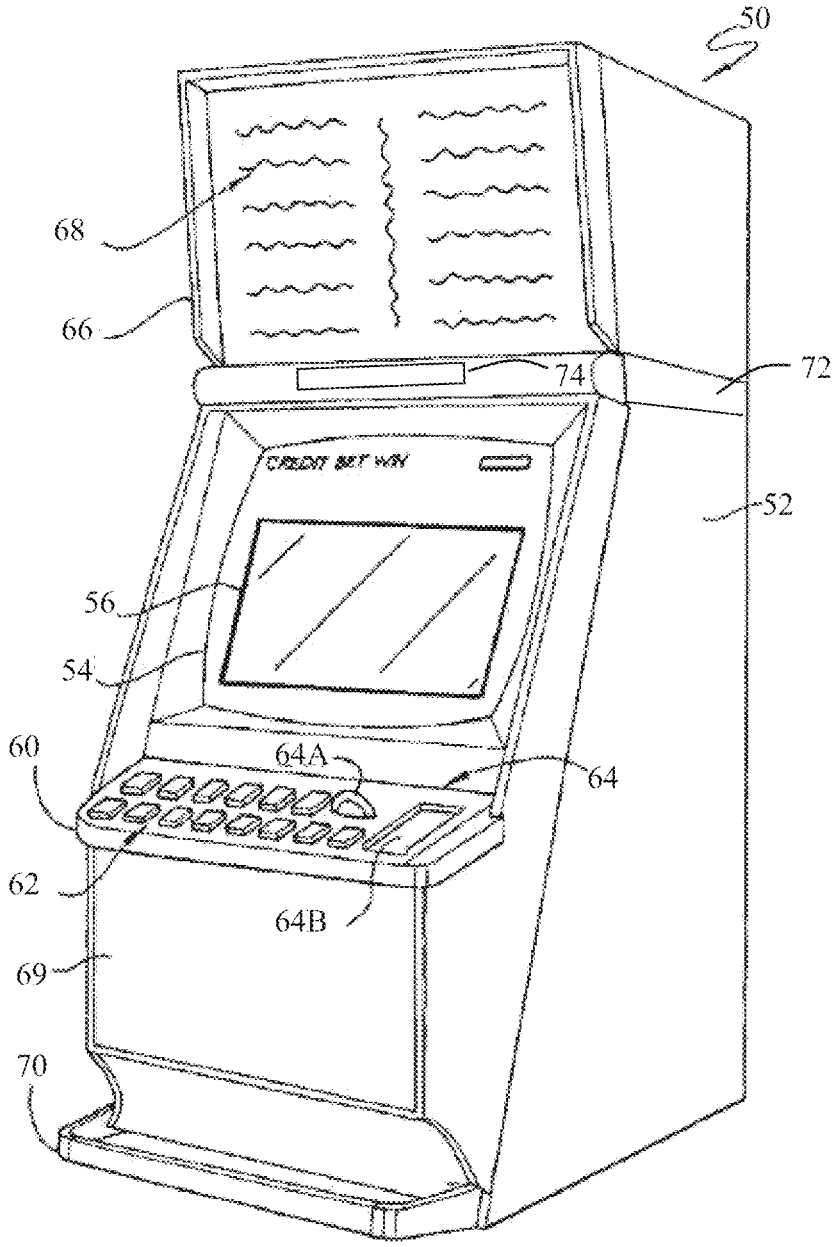
FIG. 3 is a diagrammatic representation of a gaming system in accordance with an embodiment of the present invention with the gaming system implemented in the form of a stand alone gaming machine.

A gaming system in the form of a stand alone gaming machine 50 is illustrated in FIG. 3. The gaming machine 50 includes a console 52 having a display 54 on which is displayed representations of a game 56 that can be played by a player. A mid-trim 60 of the gaming machine 50 houses a bank of buttons 62 for enabling a player to interact with the gaming machine, in particular during gameplay. The mid-trim 60 also houses a credit input mechanism 64 which in this example includes a coin input chute 64A and a bill collector 64B. Other credit input mechanisms may also be employed, for example, a card reader for reading a smart card, debit card or credit card.

A top box 66 may carry artwork 68, including for example pay tables and details of bonus awards and other information or images relating to the game. Further artwork and/or information may be provided on a front panel 69 of the console 52. A coin tray 70 is mounted beneath the front panel 69 for dispensing cash payouts from the gaming machine 50.

The display 54 is in the form of a video display unit, particularly a cathode ray tube screen device. Alternatively, the display 54 may be a liquid crystal display, plasma screen, or any other suitable video display unit. The top box 66 may also include a display, for example a video display unit, which may be of the same type as the display 54, or of a different type. The display 54 may comprise a touch screen usable by a player to interact with the gaming machine, in particular during game play.

The display 54 in this example is arranged to display representations of several reels, each reel of which has several associated symbols. Typically 3, 4 or 5 reels are provided. During operation of the game, the reels first appear to rotate then stop with typically three symbols visible on each reel. Game outcomes are determined on the basis of the visible symbols together with any special functions associated with the symbols.

A player marketing module (PMM) 72 having a display 74 is connected to the gaming machine 50. The main purpose of the PMM 72 is to allow the player to interact with a player loyalty system. The PMM has a magnetic card reader for the purpose of reading a player tracking device, for example as part of a loyalty program. However other reading devices may be employed and the player tracking device may be in the form of a card, flash drive or any other portable storage medium capable of being read by the reading device. In this example, the PMM 62 is a Sentinel III device produced by Aristocrat Technologies Pty Ltd.

Figure 4:
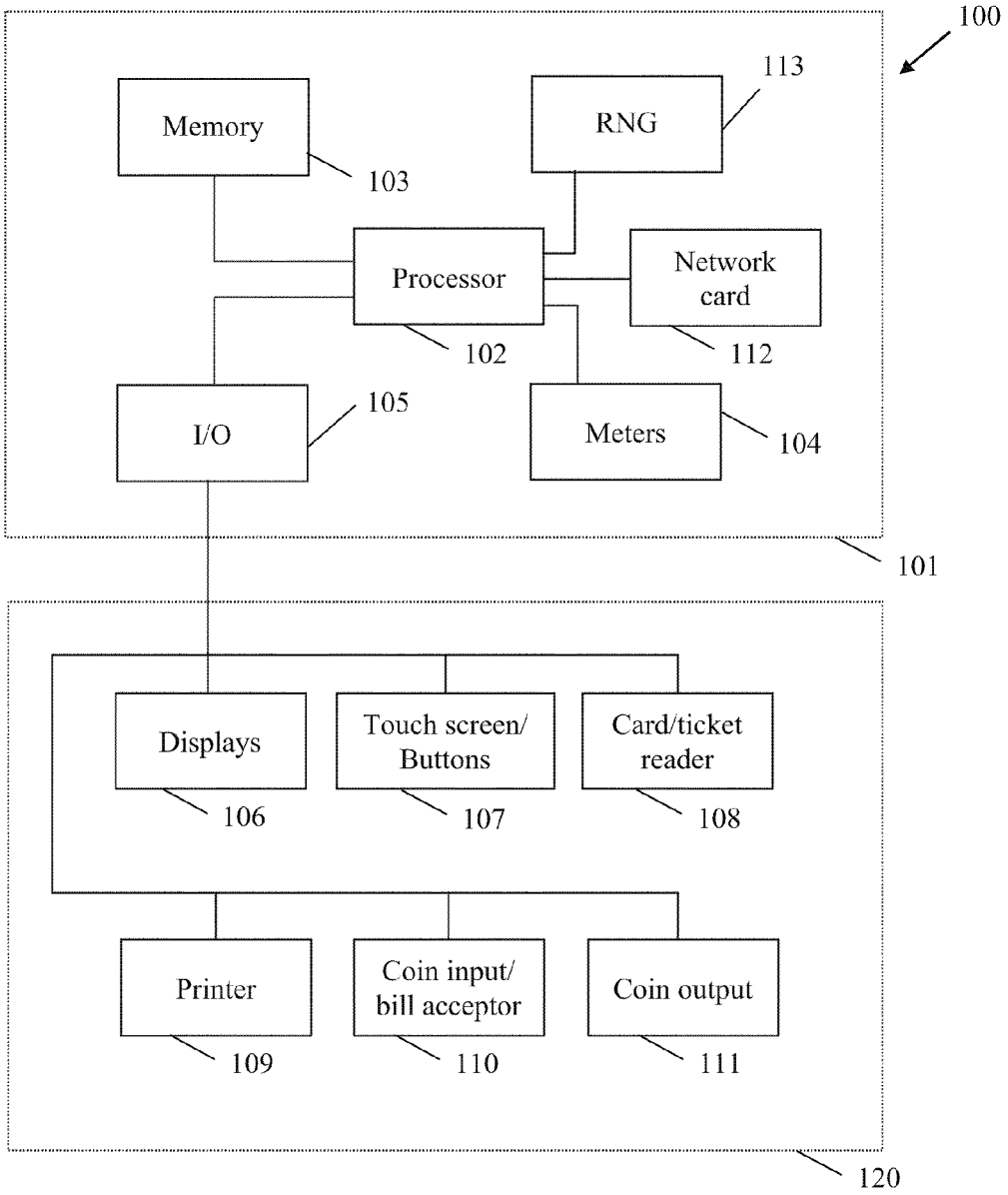
FIG. 4 is a schematic block diagram of operative components of a gaming machine shown in FIG. 3.

FIG. 4 shows a block diagram of operative components of a gaming device 100 which may be the same as or different to the gaming machine shown in FIG. 3.

The gaming machine 100 includes a game controller 101 having a processor 102. Instructions and data to control operation of the processor 102 in accordance with the present invention are stored in a memory 103 which is in data communication with the processor 102.

Typically, the gaming machine 100 will include both volatile and non-volatile memory and more than one of each type of memory, with such memories being collectively represented by the memory 103.

Figure 5:
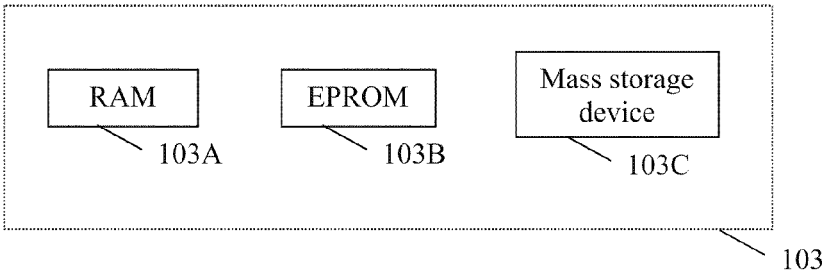
FIG. 5 is a schematic block diagram of components of a memory of the gaming machine shown in FIG. 3.

FIG. 5 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 1038 or elsewhere.

The gaming machine has hardware meters 104 for purposes including ensuring regulatory compliance and monitoring player credit, an input/output (I/O) interface 105 for communicating with a player interface 120 of the gaming machine 100, the player interface 120 having several peripheral devices. The input/output interface 105 and/or the peripheral devices may be intelligent devices with their own memory for storing associated instructions and data for use with the input/output interface or the peripheral devices. A random number generator module 113 generates random numbers for use by the processor 102.

In the example shown in FIG. 4, the peripheral devices that communicate with the game controller 101 comprise one or more displays 106, a touch screen and/or bank of buttons 107, a card and/or ticket reader 108, a printer 109, a bill acceptor and/or coin input mechanism 110 and a coin output mechanism 111. Additional hardware may be included as part of the gaming machine 100, or hardware may be omitted as required for the specific implementation.

In addition, the gaming machine 100 may include a communications interface, for example a network card 112. The network card may, for example, send status information, accounting information or other information to a central controller, server or database and receive data or commands from the central controller, server or database.

It is also possible for the operative components of the gaming machine 100 to be distributed, for example input/output devices 106,107,108,109,110,111 may be provided remotely from the game controller 101.

Figure 6:
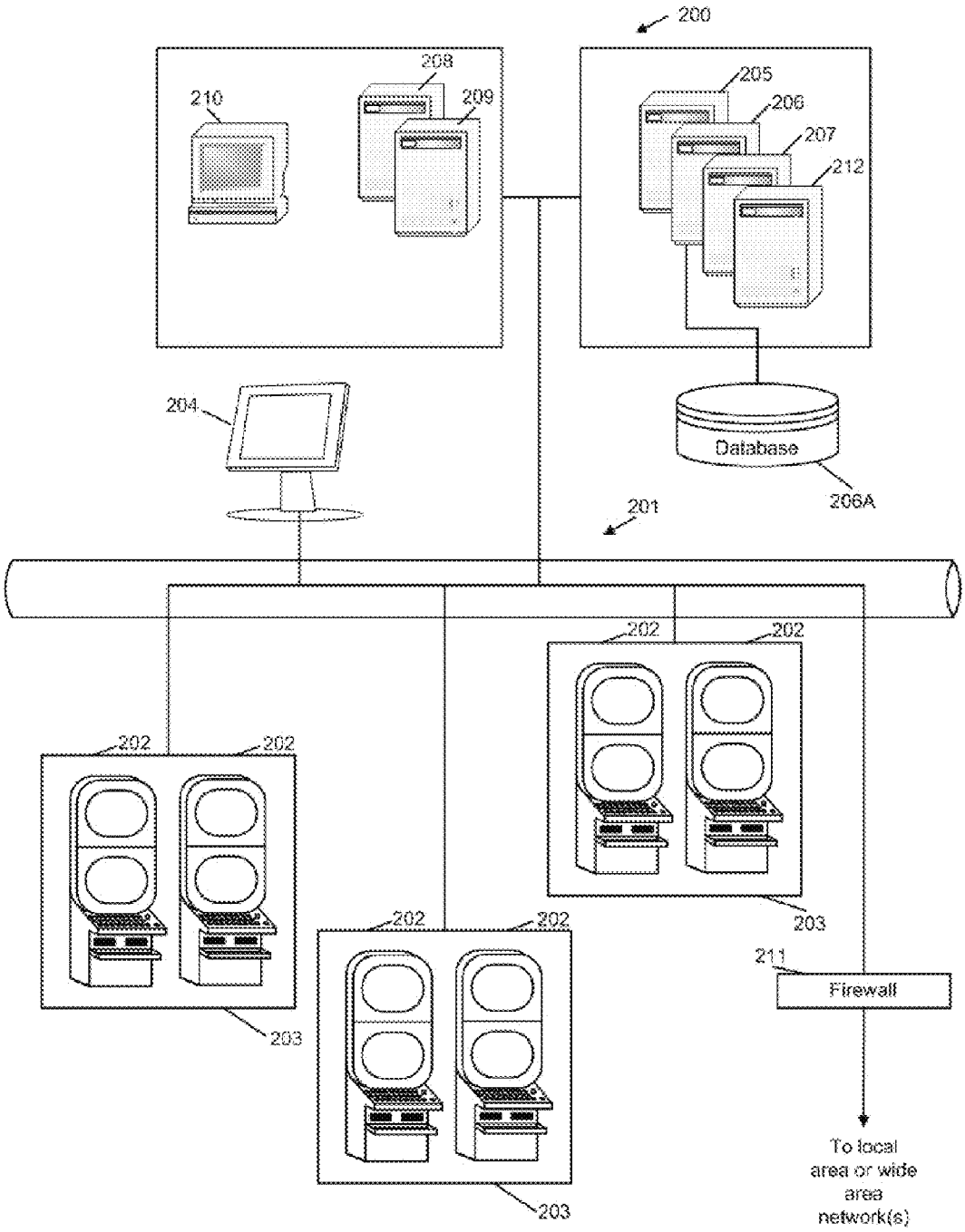
FIG. 6 is a schematic diagram of a gaming system in accordance with an alternative embodiment of the present invention wherein the gaming system is implemented over a network.

FIG. 6 shows a gaming system 200 in accordance with an alternative embodiment. The gaming system 200 includes a network 201, which for example may be an Ethernet network, a LAN or a WAN. In this example, three banks 203 of two gaming machines 202 are connected to the network 201. The gaming machines 202 provide a player operable interface and may be the same as the gaming machines 40,100 shown in FIGS. 3 and 4, or may have simplified functionality depending on the requirements for implementing game play. While banks 203 of two gaming machines are illustrated in FIG. 6, banks of one, three or more gaming machines are also envisaged.

One or more displays 204 may also be connected to the network 201. The displays 204 may, for example, be associated with one or more banks 203 of gaming machines. The displays 204 may be used to display representations associated with game play on the gaming machines 202, and/or used to display other representations, for example promotional or informational material.

In a thick client embodiment, a game server 205 implements part of the game played by a player using a gaming machine 202 and the gaming machine 202 implements part of the game. With this embodiment, as both the game server 205 and the gaming machine 202 implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to monitor and carry out the Jackpot game.

In a variation of the above thick client embodiment, the gaming machine 202 may implement the game, with the game server 205 functioning merely to serve data indicative of a game to the gaming machine 202 for implementation.

With this implementation, a data signal containing a computer program usable by the client terminal to implement the gaming system may be transferred from the game server to the client terminal, for example in response to a request by the client terminal.

In a thin client embodiment, the game server 205 implements most or all of the game played by a player using a gaming machine 202 and the gaming machine 202 essentially provides only the player interface. With this embodiment, the game server 205 provides the game controller. The gaming machine will receive player instructions, and pass the instructions to the game server which will process them and return game play outcomes to the gaming machine for display. In a thin client embodiment, the gaming machines could be computer terminals, e.g. PCs running software that provides a player interface operable using standard computer input and output components.

Servers are also typically provided to assist in the administration of the gaming system 200, including for example a gaming floor management server 208 and a licensing server 209 to monitor the use of licenses relating to particular games.

An administrator terminal 210 is provided to allow an administrator to monitor the network 201 and the devices connected to the network.

The gaming system 200 may communicate with other gaming systems, other local networks such as a corporate network, and/or a wide area network such as the Internet, for example through a firewall 211.

A loyalty program server 212 may also be provided.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random number generator engine. Alternatively, a separate random number generator server could be provided.

Examples of specific implementations of the gaming system will now be described in relation to a stand alone gaming machine 50 although it will be understood that implementation may also be carried out using other gaming system architectures such as a network architecture of the type shown in FIG. 6.

In this example, the gaming system comprises five reels, each of which has an associated set of symbols.

The reels comprise standard symbols and optionally one or more function symbols and win outcomes are determined on the basis of the symbols visible at the display positions when the reels stop rotating.

Typically, a player will purchase or otherwise obtain win entitlements such as several win lines which are used in the game to determine win outcomes. If the displayed symbols on the reels have symbols associated with a winning combination such as a winning combination disposed on a win line, the player wins a prize.

The gaming system is operable in normal game mode and special game mode and may be arranged to commence special game mode when a predetermined game outcome occurs. Special game mode may comprise one or more free games. Special game mode may commence automatically on the basis of a game event occurring during a game such as display of a particular symbol, based on game outcomes determined by the gaming system, or may be prompted by a player pressing a button on the gaming system 10 after the player has identified that a game outcome corresponding to special game mode requirements has occurred.

The gaming system 10 may also be arranged so as to determine eligibility for special game mode, for example based on the amount or type of bet placed, based on certain time periods and so on.

Special game mode may also be arranged to commence when a special game is purchased by a player.

Figure 7:
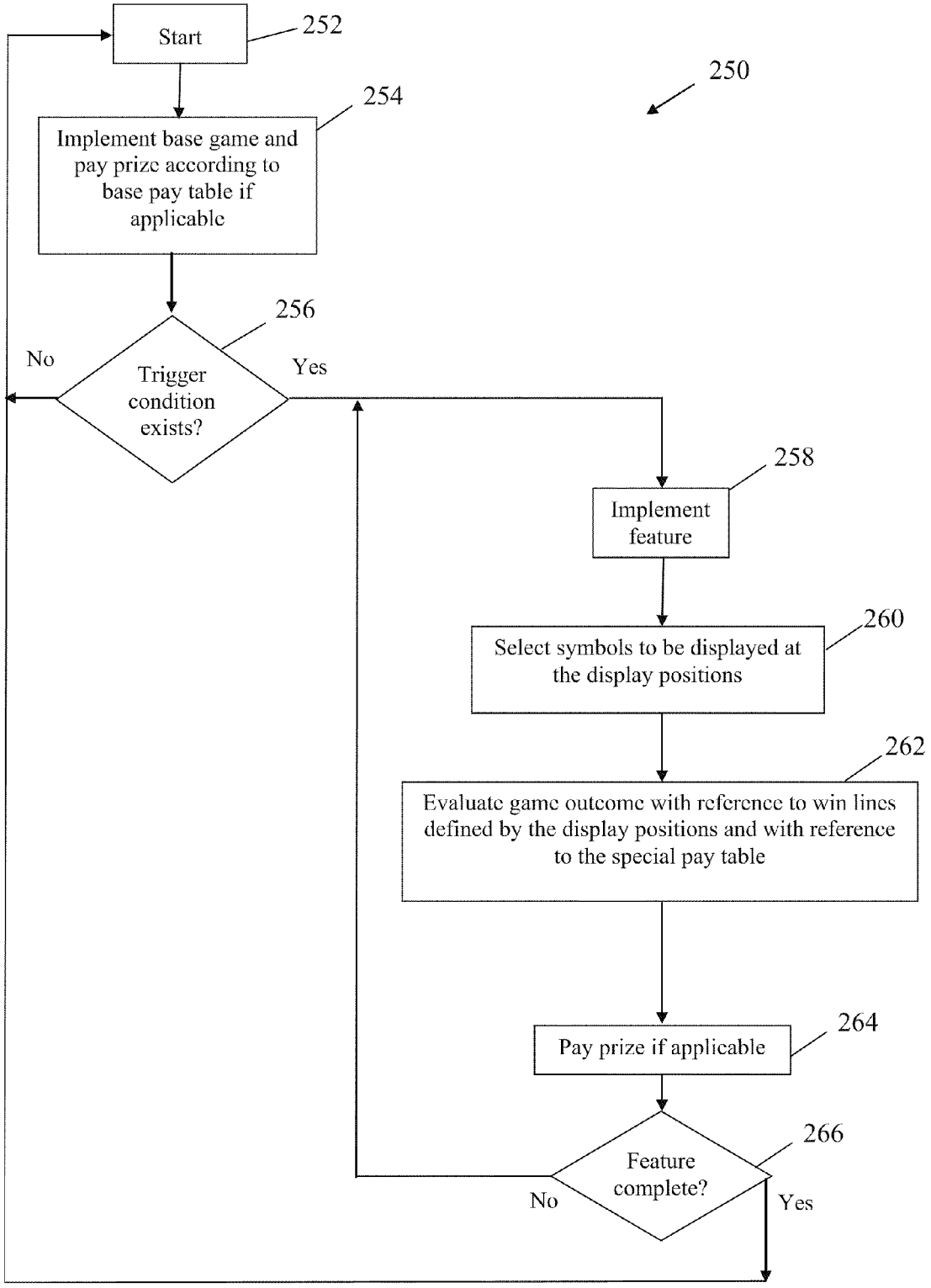
FIG. 7 is a flow diagram illustrating game play of a gaming system in accordance with an embodiment of the present invention.

A specific example will now be described in relation to flow diagram 250 shown in FIG. 7 which illustrates steps 252 to 268 of a method of gaming implemented by the gaming system according to the present embodiment.

Figure 8:
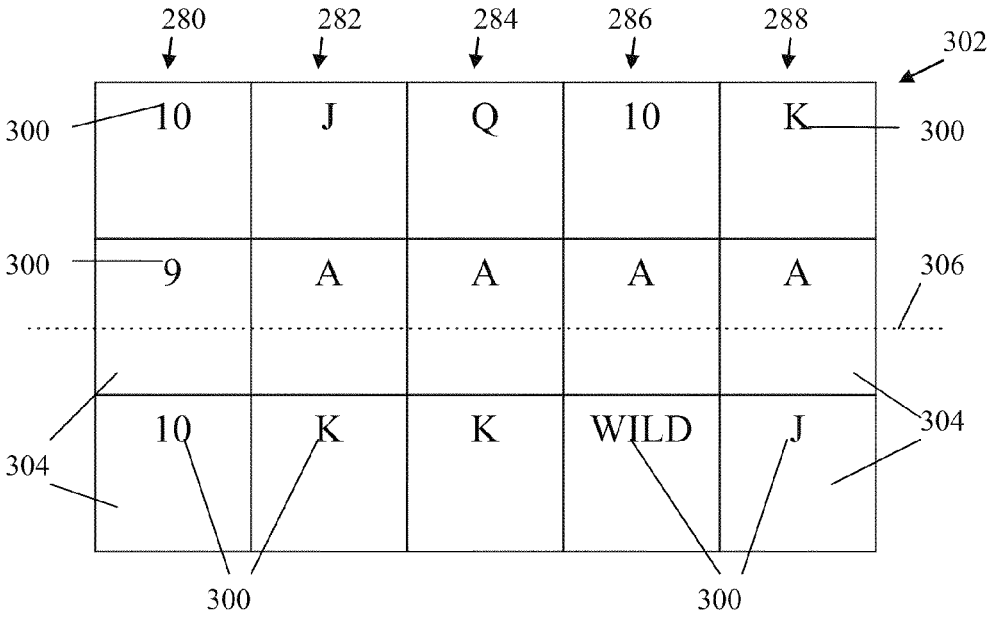
FIG. 8 is a diagrammatic representation of an example screen displayed by a gaming system in accordance with an embodiment of the present invention.

In this example five virtual reels 280, 282, 284, 286, 288 are provided and displayed on a graphical display device 54 in a display area 302, as shown in FIG. 8. However, it will be understood that any number of reels may be provided.

During implementation of a base game, the reels are spun and subsequently stopped 254 to show a plurality of symbols 300 in the display area 302. The display area 302 is divided into 15 display positions 304, with each display position 304 showing one symbol 300 and each reel including 3 associated display positions 304.

Winning outcomes are determined with reference to winning combinations of symbols 300 appearing in defined win lines 306 or defined win combinations such as defined scatter combinations. Each defined win line 306 includes one display position from each reel.

The outcome generator 28 determines 254 whether the symbols displayed at the display positions correspond to a winning outcome and, if a winning outcome exists, a prize associated with the winning outcome is awarded to the player. This determination 254 is made by comparing the symbols displayed at the display positions with a base pay table 308. The base pay table 308 may be displayed on the graphical display device 54 or, for example, on a separate display (not shown). Alternatively, the base pay table 308 may not be displayed.

Figure 9:
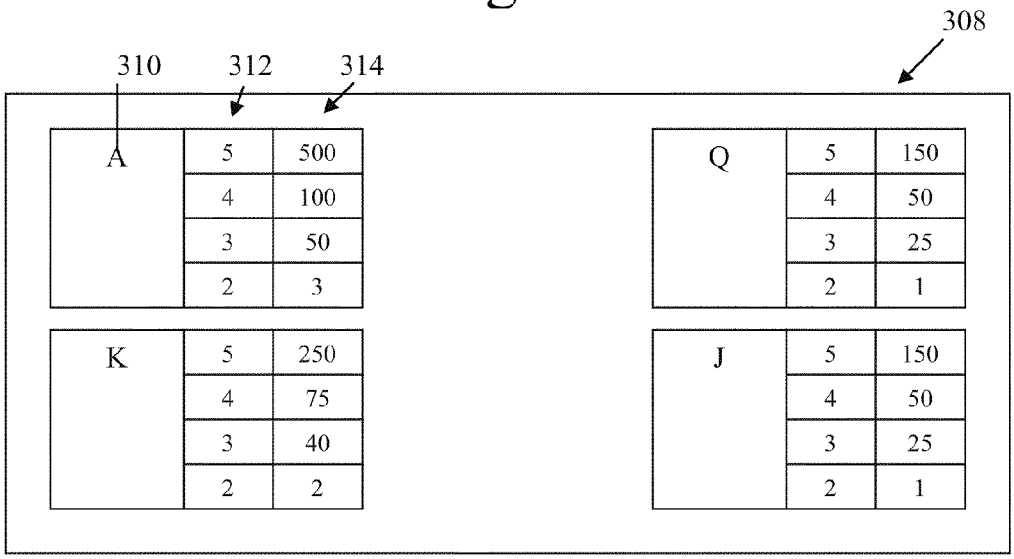
FIG. 9 is a diagrammatic representation of a pay table displayed by a gaming system in accordance with an embodiment of the present invention during implementation of normal game mode.

As shown in FIG. 9, base pay table 308 shows the number 312 of symbols 310 required in a win line 306 to achieve a corresponding prize 314. In this example, the base pay table 308 shows that five aces results in a prize of five hundred credits, four aces results in a prize of one hundred credits, three aces results in a prize of fifty credits and two aces results in a prize of three credits. The pay table also shows the prize that would result if particular numbers of King symbols (K), Queen symbols (Q) and Jack symbols (J) are displayed at display positions 304 to form at least a portion of win line 306.

It will be appreciated that this is only one example of a base pay table 308 and that any number or variation of winning outcomes and associated prizes may be shown.

In the present example a winning combination of four aces exists so a prize of one hundred credits is awarded to a player in accordance with the base pay table 308.

If a trigger condition exists 256, special game mode commences which causes implementation 258 of a special feature. The special feature may include one or more special games.

During implementation of a special game, a special pay table 316 (see FIG. 10) is used to determine win outcomes and prizes. In this example, the special pay table 316 is displayed in place of the base pay table 308. The reels are then spun and subsequently stopped to show a plurality of symbols in the display positions. Winning outcomes are then determined with reference to symbols appearing in defined win lines 306 and with reference to the special pay table 316.

Figure 10:
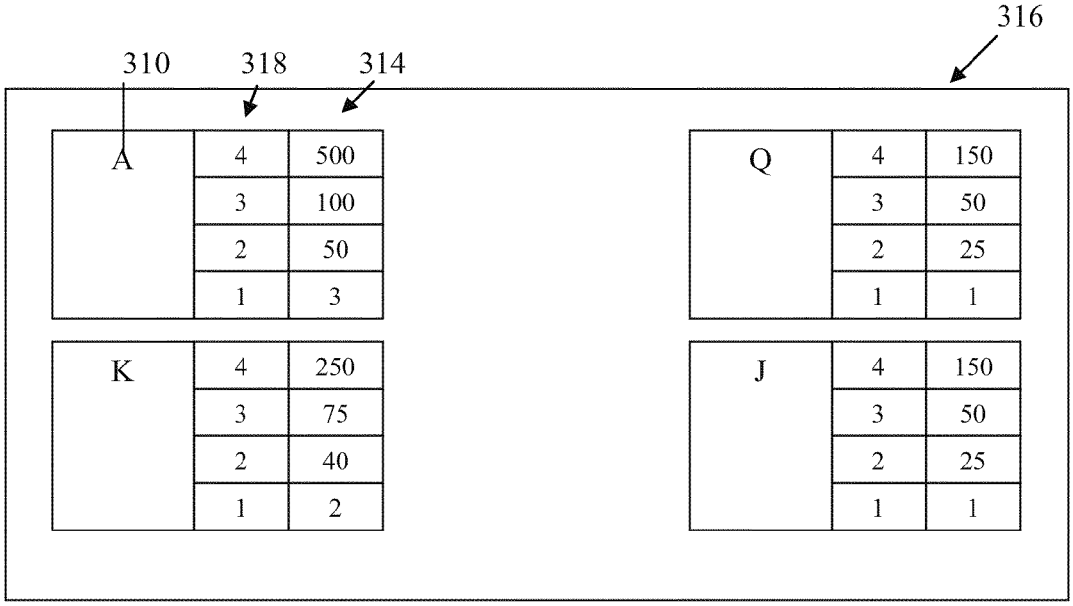
FIG. 10 is a diagrammatic representation of a modified pay table of a gaming system in accordance with an embodiment of the present invention during implementation of special game mode.

In this example, as shown in FIG. 10, the special pay table 316 shows a different number 318 of symbols 310 required to achieve the same payout 314 as that defined in the base pay table 308. In this example the special pay table 316 shows that four aces will result in a prize of five hundred credits, three aces results in a prize of one hundred credits, two aces results in a prize of fifty credits, and one ace results in a prize of three credits. A corresponding difference in the numbers of King, Queen and Jack symbols required to achieve corresponding payouts is also shown. In this way, by using the special pay table 316 during special game mode, a decreased number 318 of symbols 310 is required to achieve equivalent prizes to those attainable during normal game mode.

In one embodiment, the base pay table 308 is modified upon commencement of special game mode so as to form the special pay table 316. The modification made to the pay table 308 to form the special pay table 316 may be displayed, for example, as an animated sequence or similar.

It will be understood that with the above described embodiments the base pay table and the special pay table are based on the number of same symbols required to achieve a particular prize. However, variations are possible. For example, the base pay table and the special pay table may show any appropriate winning combination and associated payout. The pay table and the modified pay table may indicate the number of symbols required to form winning combinations such as straights, flushes and other poker hands, or winning combinations of any other type of game that may be implemented on a gaming machine. For example, in normal game mode five sequential symbols may be required to form a straight so as to achieve a particular prize whereas in special game mode only four of those five sequential symbols will be required to achieve the same prize.

Further, although the special pay table is described as being displayed in place of the base pay table during special game mode, it will be appreciated that each pay table may be displayed concurrently. Alternatively, the pay tables may not be displayed.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

It is to be understood that, if any prior art publication is referred to herein, such reference does not constitute an admission that the publication forms a part of the common general knowledge in the art, in Australia or any other country.

Modifications and variations as would be apparent to a skilled addressee are determined to be within the scope of the present invention.

The invention claimed is:

1. A method of gaming for use with a gaming machine playing a game in a normal game mode and a special game mode, and having i) a memory storing a) data indicative of symbol images of a plurality of symbols, b) a base pay table including data indicative of a first prize for winning with x number of said symbol images, and c) a special pay table including data indicative of the first prize for winning with less than x number of said symbol images, ii) a display having a plurality of display positions, iii) a controller, iv) a credit input mechanism configured to accept a physical item associated with a monetary value for establishing a credit balance, the credit balance being increasable and decreasable based at least on wagering activity, and v) a payout mechanism configured to cause a payout associated with the credit balance, the method comprising:

establishing the credit balance including receiving the physical item via said credit input mechanism;

in response to having established the credit balance via the credit input mechanism, decreasing the credit balance, and selecting via the controller a plurality of said symbol images via said memory for display on said display;

displaying on said display at said display positions the selected plurality of symbol images;

displaying on said display the base pay table;

determining via the controller whether a winning symbol outcome exists in accordance with the displayed plurality of symbol images on said display;

during said normal game mode, in response to determining that a winning symbol outcome exists, determining via the controller a prize for said winning symbol outcome using said base pay table including data indicative of the first prize for winning with x number of said symbol images;

determining via the controller whether a trigger condition exists;

in response to determining that a trigger condition exists, initiating via the controller said special game mode including displaying on said display an animated transitioning from display of said base pay table in the normal game mode to display of said special pay table in the special game mode on said display;

during said special game mode, in response to determining that a winning symbol outcome exists, determining via the controller a prize for said winning symbol outcome using said special pay table including data indicative of the first prize for winning with less than x number of said symbol images;

in response to determining that the prize using the base pay table and the prize using the special pay table, increasing via the game controller the credit balance; and causing via the payout mechanism an initiation of a payout associated with the credit balance.

2. The method of claim 1, wherein the winning symbol outcome comprises multiple symbols of the same kind.

3. The method of claim 1, wherein the winning symbol outcome comprises a win combination associated with a card game.

4. The method of claim 1, wherein a winning symbol outcome in said special game mode comprises x−1 number of said displayed symbol images.

5. The method of claim 1, and further comprising forming said special pay table from said base pay table.

6. The method of claim 1, and further comprising displaying on said display said base pay table.

7. A gaming machine configured to play a game in a normal game mode and a special game mode, the gaming machine comprising:

a memory storing a) data indicative of symbol images of a plurality of symbols, b) a base pay table including data indicative of a first prize for winning with a first combination of symbols selected from the plurality of symbols, and c) a special pay table including data indicative of winning the first prize with a second combination of symbols consisting of a subset of the first combination of symbols such that the second combination of symbols consists of fewer symbols than the first combination of symbols;

a credit input mechanism configured to accept a physical item associated with a monetary value for establishing a credit balance, the credit balance being increasable and decreasable based at least on wagering activity;

a symbol selector configured to select a plurality of said symbol images from said memory for display on said display;

a display having a plurality of display positions, and configured to display the selected plurality of symbol images;

a trigger condition determiner configured to determine whether a trigger condition exists;

a feature implementer configured to initiate said special game mode in response to determining that a trigger condition exists including displaying on the display an animated transitioning from displaying said base pay table in the normal game mode to displaying said special pay table in the special game mode;

an outcome evaluator configured to determine whether a winning symbol combination exists in accordance with the displayed plurality of symbol images;

a prize allocator configured to allocate a prize to a player when said winning symbol combination exists, said prize allocator configured (1) to determine the prize from said base pay table when in said normal game mode (2) to determine the prize from said special pay table when in said special game mode, and (3) to increase the credit balance based on the allocated prize; and a payout mechanism configured to cause an initiation of a payout associated with at least a portion of the credit balance.

8. The gaming machine of claim 7, and wherein said winning symbol combination comprises multiple symbols of the same kind.

9. The gaming machine of claim 7, and wherein said winning symbol combination comprises a winning combination associated with a card game.

10. The gaming machine of claim 7, and wherein said winning symbol combination in said special pay table comprises x−1 number of said displayed symbol images.

11. The gaming machine of claim 7, and wherein said base pay table is configurable so as to form said special pay table.

12. The gaming machine of claim 7, and wherein said display is configured to display said base pay table and said special pay table.

13. The method of claim 1, wherein:

the base pay table associates a first combination of symbols with the first prize;

the first combination of symbols consists of a first quantity of symbols selected from the plurality of symbols;

the special pay table associates a second combination of symbols with the first prize;

the second combination of symbols consists of a second quantity of symbols selected from the plurality of symbols; and the second quantity is one fewer than the first quantity.

14. The method of claim 1, wherein:

the base pay table associates a first combination of symbols with the first prize;

the first combination of symbols consists of a first quantity of a particular symbol selected from the plurality of symbols;

the special pay table associates a second combination of symbols with the first prize;

the second combination of symbols consists of a second quantity of a particular symbol selected from the plurality of symbols; and the second quantity is one fewer than the first quantity.

15. The gaming machine of claim 7, wherein:

the base pay table includes data indicative of a plurality of prizes and an associated plurality of first winning symbol combinations;

the special pay table includes data indicative of the plurality of prizes and an associated plurality of second winning symbol combinations; and the first winning combination and the second winning combination for each prize of the plurality of prizes include a common combination of symbols, but the first winning combination includes additional symbols beyond the common combination of symbols for the respective prize.

16. The gaming machine of claim 7, wherein:

said first combination consists of a first quantity of a particular symbol selected from the plurality of symbols;

said second combination consists of a second quantity of the particular symbol selected from the plurality of symbols; and said second quantity is less than the first quantity.

* * * * *